US005604187A

United States Patent [19]

Takeuchi et al.

[11] Patent Number: 5,604,187

[45] Date of Patent: Feb. 18, 1997

[54] GREASE COMPOSITION FOR CONSTANT VELOCITY JOINTS

[75] Inventors: Kiyoshi Takeuchi; Tsuyoshi Sasaki, both of Fujisawa; Tomio Hanawa, Mohka; Yoshimi Usui, Mohka; Takahiro Ogura, Mohka, all of Japan

[73] Assignees: Kyodo Yushi Co., Ltd.; Honda Giken Kogyo Kabushiki Kaisha, both of Tokyo, Japan

[21] Appl. No.: 633,081

[22] Filed: Apr. 16, 1996

[30] Foreign Application Priority Data

Mar. 22, 1996 [JP] Japan ..... 8-065809

[51] Int. Cl.[6] ..... C10M 141/06; C10M 141/08

[52] U.S. Cl. ..... 508/168; 508/258; 508/444; 508/552

[58] Field of Search ..... 508/168, 258, 508/444, 552

[56] References Cited

U.S. PATENT DOCUMENTS

| | | | |
|---|---|---|---|
| 3,840,463 | 10/1974 | Froeschmann et al. . | |
| 4,536,308 | 8/1985 | Pehler et al. . | |
| 4,759,859 | 7/1988 | Waynick . | |
| 4,787,992 | 11/1988 | Waynick . | |
| 4,830,767 | 5/1989 | Waynick . | |
| 4,840,740 | 6/1989 | Sato et al. . | |
| 4,902,435 | 2/1990 | Waynick . | |
| 5,037,564 | 8/1991 | Nishizaki et al. | 508/459 |
| 5,126,062 | 6/1992 | Barnes . | |
| 5,160,645 | 11/1992 | Okaniwa et al. . | |
| 5,207,936 | 5/1993 | Anzai et al. . | |
| 5,510,059 | 4/1996 | Yuki et al. | 252/609 |

FOREIGN PATENT DOCUMENTS

| | | |
|---|---|---|
| 0508115 | 10/1992 | European Pat. Off. . |
| 62-207397 | 9/1987 | Japan . |
| WO94/11470 | 5/1994 | WIPO . |
| WO96/02615 | 2/1996 | WIPO . |

*Primary Examiner*—Jacqueline V. Howard
*Attorney, Agent, or Firm*—Oblon, Spivak, McClelland, Maier & Neustadt, P.C.

[57] ABSTRACT

A grease composition for constant velocity joints which consists essentially of: (a) a base oil; (b) a diurea compound represented by the following general formula:

$$R^1NH—CO—NH—p—C_6H_4—CH_2—p—C_6H_4—NH—CO—NHR^2$$

(wherein $R^1$ and $R^3$ may be the same or different and each represents an aryl group or a cyclohexyl group); (c) melamine cyanurate; (d) molybdenum disulfide; and (e) a phosphorus-free sulfur extreme pressure agent, and optionally (f) molybdenum dithiocarbamate.

The grease composition exhibits excellent pitting-inhibitory effect and heat resistance.

10 Claims, No Drawings

GREASE COMPOSITION FOR CONSTANT VELOCITY JOINTS

BACKGROUND OF THE INVENTION

The present invention relates to a grease composition for use in constant velocity joints, in particular, for ball type fixed and plunging constant velocity joints. A very high contact pressure is developed between the parts of the constant velocity joints to be lubricated and the joint parts undergo complicated rolling and sliding motions. This often results in abnormal wear and metal fatigue and, in turn, leads to a spalling phenomenon, i.e., pitting of the joint parts. More specifically, the present invention relates to a grease composition for constant velocity joints which can effectively lubricate such constant velocity joints to effectively reduce the wear of joints and to effectively reduce the occurrence of any pitting of the parts.

Examples of lubricating greases conventionally used in such constant velocity joints include a lithium soap thickened extreme pressure grease containing molybdenum disulfide and a lithium soap thickened extreme pressure grease containing molybdenum disulfide and extreme pressure agents, e.g., sulfur-phosphorus or a lead naphthenate. However, these greases for constant velocity joints have not always been satisfactory in the severe working conditions which occur in the present high-performance motorcars.

The double offset type constant velocity joints and cross groove type constant velocity joints used as the plunging joints as well as Birfield joints used as the fixed joints have a structure in which torques are transmitted through 6 balls. These joints cause complicated reciprocating motions such as complicated rolling and sliding motions during rotation under a high contact pressure, stresses are repeatedly applied to the balls and the metal surfaces which come in contact with the balls and accordingly, the pitting phenomenon is apt to occur at such portions due to metal fatigue. The recent improvement in the power of engines is accompanied by an increase in the contact pressure as compared with conventional engines. Motorcars are being made lighter to improve fuel consumption and the size of joints has correspondingly been down-sized. This leads to a relative increase in the contact pressure and thus the conventional greases are ineffective in that they cannot sufficiently reduce the pitting phenomenon. In addition, the greases must also be improved in their heat resistance.

SUMMARY OF THE INVENTION

Accordingly, an object of the present invention is to provide a novel grease composition for constant velocity joints which has an excellent pitting-inhibitory effect and heat resistance.

The inventors of this invention have conducted various studies to develop a grease composition capable of optimizing the frictional wear of the constant velocity joints and of eliminating the problem of pitting of joints due to abnormal wear and metal fatigue and having improved heat resistance. The inventors have carried out a quality evaluation of greases used under lubricating conditions which are accompanied by complicated reciprocating motions such as complicated rolling and sliding motions under a high contact pressure as has been discussed above using a lublicity tester known as a high speed four ball tester, to determine extreme pressure properties of various kinds of extreme pressure agents, solid lubricants or combinations of additives. As a result, the inventors have found that a grease comprising a specific combination of a base oil, a diurea compound, melamine cyanurate, molybdenum disulfide and a phosphorus-free sulfur extreme pressure agent, and optionally molybdenum dithiocarbamate exhibits high extreme pressure properties and have confirmed, by a durability test performed using a practical constant velocity joint, that the grease can prevent the occurrence of any pitting phenomena, unlike the conventional greases for constant velocity joints and thus have completed the present invention.

The foregoing object of the present invention can effectively be accomplished by providing a grease composition for constant velocity joints which consists essentially of:

(a) a base oil;

(b) a diurea compound represented by the following general formula:

$$R^1NH—CO—NH—p—C_6H_4—CH_2—p—C_6H_4—NH—CO—NMR^2$$

wherein $R^1$ and $R^3$ may be the same or different and each represents an aryl or cyclohexyl group;

(c) melamine cyanurate;

(d) molybdenum disulfide; and (e) a phosphorus-free sulfur extreme pressure agent.

The grease composition of the present invention may further comprise component (f), molybdenum dithiocarbamate, in addition to the above components (a) to (e).

DESCRIPTION OF THE PREFERRED EMBODIMENTS

The present invention will hereunder be explained in more detail.

The base oil as Component (a) is not restricted to specific ones and may be, for instance, lubricating oils currently used such as mineral oils, ester type synthetic oils, ether type synthetic oils, hydrocarbon type synthetic oils or mixture thereof.

The diurea compound as Component (b) can be prepared through a reaction of an aromatic amine such as aniline or p-toluidine, cyclohexyl amine or a mixture thereof with a diisocyanate compound. In the diurea compound, the aryl group is preferably those having 6 or 7 carbon atoms and the rate of the aryl group in the diurea compound ranges from 100 to 0 mole %.

The melamine cyanurate as Component (c) is an adduct of melamine and cyanuric acid. Cyanuric acid is a tautomer of isocyanuric acid. Melamine isocyanurate commercially available is an adduct of one mole of melamine and one mole of cyanuric acid and is in the form of melamine isocyanurate. In the present specification, the term "melamine cyanurate" is used to mean an adduct of melamine and cyanuric acid or isocyanuric acid. Melamine cyanurate may easily be obtained as white precipitate when an aqueous melamine solution is mixed with an aqueous cyanuric acid or isocyanuric acid solution. Melamine cyanurate is commercially available as finely divided white powder having an average particle size of about 1 to 2 μm, wherein melamine molecule having 6-membered ring structure is combined with cyanuric acid molecule having 6-membered ring structure through hydrogen bonds to form a planar structure. It is believed that the planar structures are piled up and show cleavability and lublicity like molybdenum disulfide.

The molybdenum disulfide as Component (d) has widely been used as an extreme pressure agent. With regard to the lubricating mechanism thereof, the molybdenum disulfide is easily sheared under the sliding motions through the formation of a thin layer since it has a layer lattice structure and it shows effects of reducing the frictional force and of preventing seizure of joints.

The phosphorus-free sulfur extreme pressure agent as Component (a) has preferably a sulfur content ranging from 35 to 50% by weight.

The molybdenum dithiocarbamate optionally used in the present invention as Component (f) is preferably represented by the following formula:

$$(R^4R^3N—CS—S)_2—MO_3OmSn$$

wherein $R^3$ and $R^4$ independently represent an alkyl group having 1 to 24 carbon atoms, preferably 3 to 18 carbon atoms, m is 0 to 3, n is 4 to 1 and m+n=4.

The grease composition for constant velocity joints according to the present invention may further comprise antioxidants, corrosion inhibitors and/or rust inhibitors in addition to the foregoing essential components.

The grease composition for constant velocity joints according to the present invention preferably comprises, on the basis of the total weight of the grease composition, 60.0 to 98.3% by weight of the base oil (a); 1 to 25% by weight of the diurea compound (b); 0.1 to 5.0% by weight of melamine cyanurate (c); 0.5 to 5.0% by weight of the molybdenum disulfide (d); and 0.1 to 5.0% by weight of the phosphorus-free sulfur extreme pressure agent (e).

The other grease composition for constant velocity joints according to the present invention preferably comprises, on the basis of the total weight of the grease composition, 55.0 to 98.2% by weight of the base oil (a); 1 to 25% by weight of the diurea compound (b); 0.1 to 5.0% by weight of melamine cyanurate (c); 0.5 to 5.0% by weight of the molybdenum disulfide (d); 0.1 to 5.0% by weight of the phosphorus-free sulfur extreme pressure agent (e); and 0.1 to 5.0% by weight of the molybdenum dithiocarbamate (f).

If the amount of the diurea compound (b) is less than 1% by weight, the thickening effect thereof tends to become too low to convert the composition into a grease, while if it exceeds 25% by weight, the resulting composition tends to become too hard to ensure the desired effects of the present invention. Moreover, it becomes difficult to obtain the desired effects of the present invention if the amount of the melamine cyanurate (c) is less than 0.1% by weight, the amount of the molybdenum disulfide (d) is less than 0.5% by weight, or the amount of the phosphorus-free sulfur extreme pressure agent (e) is less than 0.1% by weight. On the other hand, if the amount of the melamine cyanurate (c) is more than 5% by weight, the amount of the molybdenum disulfide (d) is more than 5% by weight, or the amount of the phosphorus-free sulfur extreme pressure agent (e) is more than 5% by weight, any further improvement in the effects cannot be expected and these components rather inversely affect the pitting-inhibitory effect of the present invention. If the amount of the molybdenum dithiocarbamate (f) is less than 0.1% by weight or more than 5% by weight, the effects obtained by the addition of the component are not remarkable.

The present invention will hereunder be described in more detail with reference to the following non-limitative working Examples and Comparative Examples.

EXAMPLES 1 TO 6 AND COMPARATIVE EXAMPLES 1 TO 5

There were added, to a container, 4100 g of a base oil and 1012 g of diphenylmethane-4,4'-diisocyanate and the mixture was heated to a temperature between 70°and 80° C. To another container, there were added 4100 g of a base oil, 563 g of cyclohexylamine and 225 g of aniline followed by heating at a temperature between 70°and 80° C. and addition thereof to the foregoing container. The mixture was then reacted for 30 minutes with sufficient stirring, the temperature of the reaction system was raised up to 160° C. with stirring and the reaction system was allowed to cool to give a base urea grease. To the base grease, there were added the following additives listed in Table 1 in amounts likewise listed in Table 1 and an optional and additional amount of the base oil and the penetration of the resulting mixture was adjusted to the No. 1 grade by a three-stage roll mill.

In all of the abovementioned Examples and Comparative Examples, a mineral oil having the following properties was used as the base oil.

| Viscosity: | |
|---|---|
| at 40° C. | 130 $mm^2/s$ |
| at 100° C. | 14 $mm^2/s$ |
| Viscosity Index: | 106 |

Moreover, a commercially available lithium grease containing molybdenum disulfide, a sulfur-phosphorus extreme pressure agent and a lead naphthenate was used as the grease of Comparative Example 6.

Physical properties of these greases were evaluated according to the methods detailed below. The results thus obtained are also summarized in Table 1.

Penetration

According to ISO 2137

Dropping point

According to ISO 2176

High Speed Four Ball Extreme Pressure Test

According to ASTM D 2596

Evaluated Item: Weld Point

Durability Test on Bench Using Real Joints

The greases were inspected, under the following conditions, for the occurrence of pitting by a durability test on a bench using real joints.

| Test Conditions: | |
|---|---|
| Number of Revolutions: | 1500 rpm |
| Torque: | 196 N · m |
| Angle of Joint: | 10° |
| Operation Time: | 200 hours |
| Type of Joint Used: | Birfield Joint |

Evaluated Item

Occurrence of pitting at each part of the joints after operation.

TABLE 1

| | Example | | | | | |
|---|---|---|---|---|---|---|
| Component | 1 | 2 | 3 | 4 | 5 | 6 |
| 1) Diurea Grease | 96.0 | 95.5 | 94.5 | 96.0 | 95.0 | 93.5 |
| 2) Melamine Cyanurate | 1.5 | 1.5 | 1.5 | 1.0 | 1.5 | 1.5 |

TABLE 1-continued

| | | | | | | |
|---|---|---|---|---|---|---|
| (MCA) | | | | | | |
| 3) Molybdenum Disulfide | 2.0 | 2.0 | 2.0 | 2.0 | 2.0 | 2.0 |
| 4) Extreme Pressure Agent | 0.5 | 1.0 | 2.0 | 1.0 | 1.0 | 1.0 |
| 5) Molybdenum Dithiocarbamate | — | — | — | — | 0.5 | 2.0 |
| 6) Penetration (60 W) | 328 | 325 | 331 | 332 | 323 | 332 |
| 7) Dropping Point (°C.) | 260< | 260< | 260< | 260< | 260< | 260< |
| 8) High Speed Four Ball Weld Point (kgf) | 500 | 500 | 500 | 500 | 500 | 500 |
| 9) Durability | ○ | ○ | ○ | ○ | ○ | ○ |

| | Comparative Example | | | | | |
|---|---|---|---|---|---|---|
| Component | 1 | 2 | 3 | 4 | 5 | 6 |
| 1) Diurea Grease | 98.5 | 98.0 | 99.0 | 99.5 | 97.0 | |
| 2) Melamine Cyanurate (MCA) | 1.5 | — | — | — | — | |
| 3) Molybdenum Disulfide | — | 2.0 | — | — | 2.0 | |
| 4) Extreme Pressure Agent | — | — | 1.0 | — | 1.0 | |
| 5) Molybdenum Dithiocarbamate | — | — | — | 0.5 | — | |
| 6) Penetration (60 W) | 324 | 322 | 330 | 325 | 331 | 275 |
| 7) Dropping Point (°C.) | 260< | 260< | 260< | 260< | 260< | 190 |
| 8) High Speed Four Ball Weld Point (kgf) | 200 | 250 | 200 | 200 | 315 | 400 |
| 9) Durability | X | X | X | X | X | X |

1) Diurea grease using a diurea compound wherein cyclohexyl amine and aniline are used as a monoamine
2) Melamine cyanurate available from Mitsubishi Chemical Co., Ltd. under the trade name of MCA
3) Molybdenum disulfide available from Climax Molybdenum Company under the trade name of Molysulfide; average particle size: 0.45 μm
4) Phosphorus-free sulfur extreme pressure agent available from Lubrizol Japan under the trade name of Anglamol 33
5) Molybdenum dithiocarbamate available from R. T. Vanderbilt under the trade name of Molyvan A After the durability test was conducted for 200 hours, these greases were evaluated according to the following criteria:

○: No pitting was observed;

×: Pitting was observed.

As has been discussed above in detail, the grease composition for constant velocity joints according to the present invention consists essentially of (a) a base oil; (b) a specific diurea compound; (c) melamine cyanurate; (d) molybdenum disulfide; and (e) a phosphorus-free sulfur extreme pressure agent; and optionally (f) dithiocarbamate and thus exhibits excellent pitting-inhibitory effect and heat resistance as is also apparent from the comparison of the results of Examples with those of Comparative Examples.

What is claimed is:

1. A grease composition for constant velocity joints consisting essentially of:

(a) a base oil;

(b) a diurea compound represented by the following general formula:

$$R^1NH—CO—NH—p—O_6H_4—CH_2—p—C_6H_4—NH—CO—NHR^2$$

wherein $R^1$ and $R^3$ may be the same or different and each represents an aryl or cyclohexyl group;

(c) melamine cyanurate;

(d) molybdenum disulfide; and (e) a phosphorus-free sulfur extreme pressure agent.

2. The grease composition for constant velocity joints of claim 1 wherein the composition further comprises (f) molybdenum dithiocarbamate.

3. The grease composition for constant velocity joints of claim 1 wherein the composition comprises, on the basis of the total weight of the composition, 60.0 to 98.3% by weight of the base oil (a); 1 to 25% by weight of the diurea compound (b); 0.1 to 5.0% by weight of melamine cyanurate (c); 0.5 to 5.0% by weight of the molybdenum disulfide (d); and 0.1 to 5.0% by weight of the phosphorus-free sulfur extreme pressure agent (e).

4. The grease composition for constant velocity joints of claim 2 wherein the composition comprises, on the basis of the total weight of the composition, 55.0 to 98.2% by weight of the base oil (a); 1 to 25% by weight of the diurea compound (b); 0.1 to 5.0% by weight of melamine cyanurate (c); 0.5 to 5.0% by weight of the molybdenum disulfide (d); 0.1 to 5.0% by weight of the phosphorus-free sulfur extreme pressure agent (e); and 0.1 to 5.0% by weight of the molybdenum dithiocarbamate (f).

5. The grease composition for constant velocity joints of claim 1 or 2 wherein the phosphorus-free sulfur extreme pressure agent contains sulfur in the amount of from 35 to 50% by weight.

6. The grease composition for constant velocity joints of claim 1 or 2 wherein the aryl group represented by $R^1$ and $R^3$ has 6 or 7 carbon atoms.

7. The grease composition for constant velocity joints of claim 1 or 2 wherein the diurea grease contains a diurea compound wherein cyclohexyl amine and aniline are used as a monoamine.

8. The grease composition for constant velocity joints of claim 2 wherein the molybdenum dithiocarbamate is represented by the following formula:

$$(R^4R^3N—CS—S)_2—Mo_2OmSn$$

wherein $R^3$ and $R^4$ independently represent an alkyl group having 1 to 24 carbon atoms, m is 0 to 3, n is 4 to 1 and m+n=4.

9. The grease composition for constant velocity joints of claim 1 or 2 wherein said constant velocity joints are constant velocity plunging ball joints.

10. The grease composition for constant velocity joints of claim 1 or 2 wherein said constant velocity joints are constant velocity fixed ball joints.

* * * * *